US005711870A

United States Patent [19]

Storm et al.

[11] Patent Number: 5,711,870

[45] Date of Patent: Jan. 27, 1998

[54] DELAYED COKING PROCESS WITH WATER AND HYDROGEN DONORS

[75] Inventors: David Anthony Storm, Montvale, N.J.; Peter Charles Ricci, Beacon, N.Y.

[73] Assignee: Texaco Inc., White Plains, N.Y.

[21] Appl. No.: 654,485

[22] Filed: May 28, 1996

[51] Int. Cl.[6] ..... C10G 9/00

[52] U.S. Cl. ..... 208/131; 208/127; 208/13; 208/125; 208/50

[58] Field of Search ..... 208/131, 50, 125

[56] References Cited

U.S. PATENT DOCUMENTS

| | | | |
|---|---|---|---|
| 4,302,324 | 11/1981 | Chen et al. | 208/131 |
| 4,421,629 | 12/1983 | York et al. | 208/131 |
| 4,430,197 | 2/1984 | Poynor et al. | 208/131 |
| 4,455,219 | 6/1984 | Jassen | 208/131 |
| 5,389,234 | 2/1995 | Bhargava et al. | 208/131 |
| 5,443,361 | 8/1995 | Scalliet et al. | 208/131 |
| 5,466,361 | 11/1995 | Heck et al. | 208/131 |
| 5,490,918 | 2/1996 | Meek | 208/131 |

*Primary Examiner*—Helane Myers

*Attorney, Agent, or Firm*—Henry H. Gibson; Eugene C. Ruzcidlio

[57] ABSTRACT

A residual oil feedstock comprises carbon residue measured according to ASTM D-4530. The feedstock is admixed with water/steam in an amount of 10 wt % to 30 wt % and optionally a hydrogen donor, such as methane and/or gas oil derived from recycle. The resulting admixture is subjected to delayed coking reaction conditions. The process yields hydrocarbon liquids in an increased amount. Coke make and gas make are thereby reduced.

22 Claims, 1 Drawing Sheet

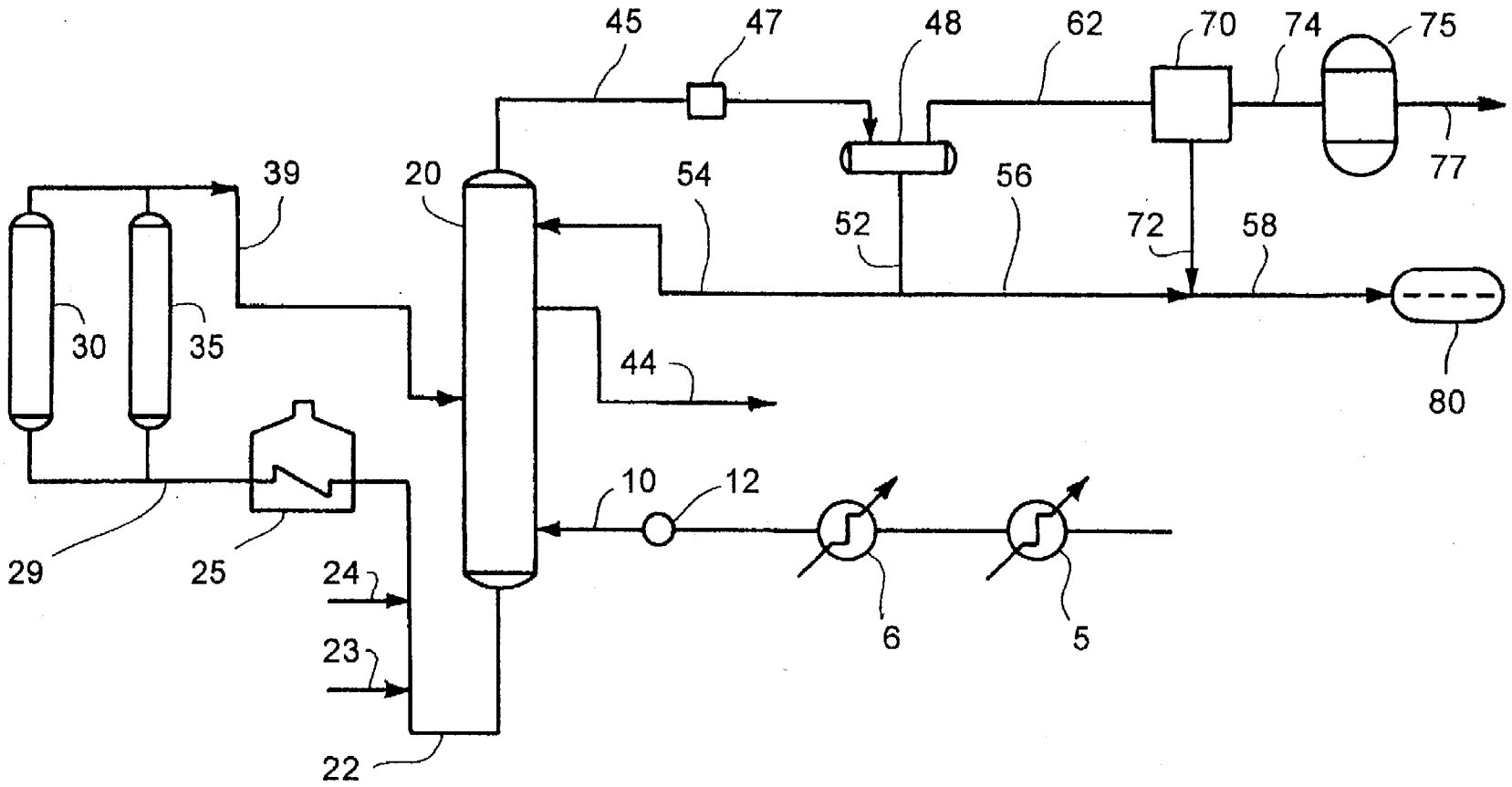
75
77
80
74
58
70
72
62
5
56
48
6
52
47
12
54
44
45
10
20
22
24
23
39
25
35
30
29

DELAYED COKING PROCESS WITH WATER AND HYDROGEN DONORS

BACKGROUND OF THE INVENTION

1. Field Of The Invention

The invention relates to a petroleum refining process. More particularly, the invention relates to a delayed coking process for converting petroleum based feedstocks to coke, hydrocarbon liquids and gases. Most particularly the invention relates to converting a residual hydrocarbon feedstock preferentially to hydrocarbon liquids.

2. Description of Other Related Methods In The Field

In a delayed coking process, a heavy liquid hydrocarbon fraction is converted to a solid coke and lower boiling liquid and hydrocarbon gases. The heavy liquid hydrocarbon fraction is typically a residual petroleum based oil or a mixture of residual oil with other heavy hydrocarbon fractions.

In a typical delayed coking process, the residual oil is heated by exchanging heat with liquid products from the process and is fed into a fractionating tower wherein light end products are removed from the residual oil. The residual oil is then pumped from the bottom of the fractionating tower through a tube furnace where it is heated under pressure to coking temperature and then discharged into a coking drum.

In the coking reaction, residual oil feedstock is thermally decomposed into solid coke, condensable liquid and gaseous hydrocarbons. The liquid and gaseous hydrocarbons are continuously removed from the coke drum and returned to the fractionating tower where they are separated into hydrocarbon fractions.

Liquid hydrocarbon fractions are commercially preferred rather than coke or hydrocarbon gases. The relative amount of liquid hydrocarbon produced by delayed coking is primarily dependent upon feedstock composition. At delayed coking conditions, asphaltenes precipitate quickly, forming coke. N. P. Lieberman, *Oil and Gas Journal*, Vol. 76, pp. 67–69 (Mar. 27, 1989) reports that the theoretical minimum coke that is produced from a feedstock is equal to the asphaltene content. However, more coke is produced than is accounted for by the asphaltene content. The amount of coke expected is the amount of asphaltene measured by the Carbon Residue Test according to ASTM D-4530. It is well known in the art that the actual coke yield from a feedstock is approximately 1.6 times the carbon residue.

Asphaltene is defined as the amount of hydrocarbon residue which is insoluble in heptane and soluble in benzene. In the art the term "heptane insoluble" is understood to mean asphaltene. Carbon residue is the amount of hydrocarbon residue which cannot be volatilized in a simulated coking test. The simulated coking test is ASTM D-4530 Carbon Residue Test.

R. J. Hengstebeck, *Petroleum Processing*, McGraw-Hill Book Co., Inc. (1959) pp. 131–136 and 185 reports that the injection of a small amount of steam or water into coker furnace tubes retards the build-up of the coke in the furnace tubes. Water injection in the amount of 0.1% of the feedstock or less is typical.

U.S. Pat. No. 4,421,629 teaches that the injection of a small amount of steam into dust laden heavy oil from oil shale, coal or tar sands retards coke formation in the furnace tubes of a delayed coker.

U.S. Pat. No. 4,455,219 teaches that the injection of a small amount of steam into the furnace tubes is energy inefficient and can adversely influences coke quality.

European Patent Application 87305009.0 (1987), teaches that the amount of coke formed in the coke drum is reduced by injecting steam into the coke drum to reduce the partial pressure of the heavy oil.

It would be desirable to find a cost effective method of producing more hydrocarbon liquid and less coke and gas from a feedstock in the delayed coking process.

SUMMARY OF THE INVENTION

The invention is a delayed coking process for the conversion of a residual oil feedstock to coke, hydrocarbon liquid and gas. In the improvement the amount of carbon residue in the feedstock is measured according to ASTM D-4530. Water or steam is admixed with the feedstock in an amount of 3 wt % to 70 wt % to produce an admixture. The admixture is subjected to delayed coking reaction conditions. As a result, the coke yield is less than 1.6 times the amount of carbon residue in the feedstock.

In a second embodiment, it has been found that when the admixture comprises 10 wt % to 70 wt % water or steam, the process yields a reduced amount of gas, i.e. in an amount less than 10 wt % of the amount of feedstock.

The process is useful for converting a residual oil feedstock to hydrocarbon liquid while yielding a lesser amount of coke and gas.

BRIEF DESCRIPTION OF THE DRAWING

The Drawing is a process flow diagram of a delayed coking process with fractionation facilities for gas and liquid recovery.

DETAILED DESCRIPTION OF THE INVENTION

The residual oil for the process may be any hydrocarbon oil derived from petroleum, shale oil, tar sands, coal, waste oil and mixtures thereof and containing a large proportion of oil boiling above 1000° F. (538° C.). Examples of heavy hydrocarbon oil feedstocks suitable for use according to the invention are heavy petroleum oils, topped heavy petroleum oils, petroleum atmospheric distillation bottoms, petroleum vacuum distillation bottoms, tar sand bitumen, coal derived hydrocarbons, hydrocarbon residues, heavy gas oil, heavy cycle gas oil, deasphalted oil, deasphalter asphalt, lube extracts, waste oil and mixtures thereof. These hydrocarbon oils comprise amounts of sulfur ranging generally from 0.1 wt % to 10 wt %, typically 1 wt % to 4 wt %.

Reference is made to the Drawing. A residual oil, preferably atmospheric residuum, vacuum residuum, or mixtures thereof is flowed through line 10. A sample of feedstock is taken from line 10 and analyzed for carbon residue according to ASTM D-4530. Feedstock flow rate is also measured by flow measurement means 12 such as an orifice meter, turbine meter, tank gauge and the like. It is typical to take the sample of feedstock at the point of flow measurement means 12 to utilize the available sample taps and pressure differential.

The feedstock is heated with heat integration in heat exchangers 5 and 6 and passed to the lower portion of coker fractionator 20. Essentially all of this feedstock composition is withdrawn from the bottom of coker fractionator 20 via line 22 and is injected with 3 wt % to 70 wt %, preferably 10 wt % to 30 wt % water through line 23.

Mixtures comprising 3 wt % to 16 wt % are oil continuous. Mixtures with greater than about 16 wt % water are water continuous. However, they may separate on standing into an oil continuous mixed phase and a water phase. Mixtures can be vigorously mixed to form water or oil continuous emulsions. The most effective mixtures comprise 10 wt % to 30 wt % water which bridges the phase inversion proportion of about 16 wt % water. Oil continuous and water continuous emulsions overcome the phase inversion and separation phenomena and provide a large contact area between hydrocarbon and water. The Examples demonstrate these emulsions which were formed at the furnace tube inlet.

Methods of forming oil-water emulsions and oil-in steam foams are well known in the art. A high shear pump or blender such as a motionless mixer or Waring blender may be used. In the Example both a frit and a steam sparger were used. These can also be used in combination with small amounts of emulsifying chemicals referred to generally as emulsifiers.

Water is understood to mean liquid water, steam or any mixture thereof. For economy, liquid water or saturated steam at 1 atm to 8 atm pressure is envisioned. The admixture is passed via line 22 to tube furnace 25. The feedstock-water admixture may be supplemented with 0.01 wt % to 33 wt % of a hydrogen donor via line 24. The preferred amount of hydrogen donor liquid is 0.1 wt % to 15 wt %. A preferred amount of hydrogen donor gas is 0.01 wt % to 1 wt %.

The hydrogen donor may be any of the hydrocarbon liquids or gases that are utilized to supplement a reaction mixture with hydrogen. Hydrogen per se may be used. For economy, methane generated in the process may be recycled before or after amine scrubbing to remove hydrogen sulfide. Carbon monoxide and carbon monoxide mixtures with hydrogen known as synthesis gas are used based on availability.

Carbon monoxide is referred to as a hydrogen donor based on its potential to consume oxygen. Synthesis gas is a mixture of hydrogen and carbon monoxide produced by the combustion of a hydrocarbon such as coal, petroleum oil or gas with insufficient oxygen for complete oxidation. Synthesis gas composition is dependent on the feedstock composition. A substantially pure oxygen feed to the partial oxidation generator produces synthesis gas comprising 10 to 60 mole % hydrogen, 20 to 60 mole % carbon monoxide, and 5 to 60 mole % carbon dioxide on a dry basis. With as the oxygen source, synthesis gas composition comprises 2 to 20 mole % hydrogen, 5 to 25 mole % carbon monoxide and 5 to 25 mole % carbon dioxide. The synthesis gas also includes lesser amounts of methane, nitrogen, hydrogen sulfide, carbon sulfonile and argon.

Liquid hydrogen donors are often partially hydrogenated polynuclear aromatics. Examples include tetralin, partially hydrogenated heavy aromatics such as partially hydrogenated heavy gas oil, and partially hydrogenated coal liquids. Other examples include light and heavy coker gas oils and heavy cycle gas oils. Additional examples include heavy aromatic streams derived from fluid catalytic cracking (FCC), waxes and heavy paraffins such as from lube oil dewaxing and alkylate.

The feedstock-water-hydrogen donor admixture is heated in tube furnace 25 under pressure to coking temperature and then passed immediately to either one of two coke drums 30 and 35.

Coke drums 30 and 35 are operated cyclically. One drum, e.g. coke drum 30, is filled with feedstock admixture via line 29 and thermally cracked, producing coke, condensable hydrocarbon liquids and vapors. The other drum, e.g. coke drum 35, is emptied of coke and readied for refilling. Coke is withdrawn from the lower end of coke drum 35 by removing the lower head (not shown). Condensable liquids and vapors are continuously withdrawn via conduit 39 and passed to coker fractionator 20.

The coking reaction is a thermal cracking of hydrocarbon residuum feedstock. This reaction is carried out at temperatures of 850° F. (454° C.) to 1000° F. (538° C.) and pressures of 1 atm to 8 atm. Although large quantities of coke are produced, the coking process also yields condensable hydrocarbon liquids and vapors. The hydrocarbon products include in various proportions, the full range of hydrocarbons from methane and ethane to a heavy coker gas oil consisting of a 650° F. (343° C.) to 800° F. (427° C.) fraction. Hydrocarbon liquids boiling above about 800° F. (427° C.) are passed via line 22 back to coke drums 30 and 35.

Boiling between the methane-ethane fraction and the heavy coker gas oil fraction are a number of intermediate boiling hydrocarbons which are withdrawn as fractions selected by product demand and the refining equipment available to recover them. These products include fuel gas, propane/propylene, butane/butylene, light naphtha, heavy naphtha, light coker gas oil boiling between 400° F. (204° C.) and 650° F. (343° C.), and heavy coker gas oil boiling above 650° F. (343° C.) to about 850° F. (454° C.).

A number of liquid fractions can be withdrawn as side streams from the coker fractionator generically shown as side stream 44. Multiple side streams may be taken for fractions such as light coker gas oil and heavy coker gas oil, represented by side stream 44.

A wide boiling range overhead fraction is taken from coker fractionator 20 via line 45. The fraction passes through air fin condenser and cooler 47 which condenses a substantial portion of the fraction forming a mixed vapor/liquid mixture which is passed to accumulator 48. Essentially all of the hydrogen sulfide produced in coke drums 30 and 35 passes through accumulator 48. The sulfur is in forms other than hydrogen sulfide. For example, sulfur containing mercaptan is present in the hydrocarbon liquid.

A portion of the hydrocarbon liquid from accumulator 48 is returned to coker fractionator 20 as reflux under temperature control via line 52 and reflux line 54. The lightest condensable liquid is withdrawn under level control via line 56. The vapor which is uncondensed at accumulator 48 temperature and pressure is withdrawn under pressure control.

A portion of the hydrocarbon liquid from accumulator 48 is returned to coker fractionator 20 as reflux under temperature control via line 52 and reflux line 54. The remaining sour liquid passes under level control via line 52, line 56 and line 58 to accumulator 80.

The vapor from accumulator 48 passes under pressure control via line 62 to compressor station 70. In compressor station 70 the vapor is compressed in the first of two stages from about 2–25 psig to 50–100 psig. This first stage compressed vapor is cooled to a temperature of 90° F. to 120° F. to condense additional liquid which is removed via line 72. The remaining vapor is compressed in the second stage to a pressure of 175 psig to 250 psig. The compressed vapor is then cooled to 90° F. to 120° F. to condense additional liquid which is removed via line 72. The combined liquid phases via line 72 and line 58 to accumulator 80.

Sulfur removal means comprises any of the industrial processes for removing hydrogen sulfide from a flowing hydrocarbon stream. In the petroleum refining industry this is typically amine scrubbing in which the vapor or liquid hydrocarbon stream is contacted countercurrently with a lean aqueous solution of alkanol amine in an absorber vessel. The two alkanol amines in wide commercial use for this purpose are monoethanolaine (MEA) and diethanolamine (DEA). Triethanolamine (TEA) and methyldiethanolamine (MDEA) have also been used for this purpose. The lean aqueous alkanol amine absorbs acid gases comprising primarily hydrogen sulfide and lesser amounts of carbon dioxide from the hydrocarbon stream. The acid rich stream is passed to a stripper vessel in which the aqueous amine solution is reactivated by stream stripping acid gases from the aqueous alkanol amine solution.

Over 90% of the hydrogen sulfide produced in the process from the feedstock is removed in sulfur removal means 75. The sour hydrocarbon is contacted countercurrently with a lean aqueous amine solution. Theoretically the treating rate could be equimolar amount of amine with the hydrogen sulfide. For practical considerations, an amount of amine in molar excess of the hydrogen sulfide is used. For MEA, the design treating rate for a 15 vol % aqueous MEA solution is 4 lb mole MEA/lb mole hydrogen sulfide at 100° F. to 120° F. This treating rate may be adjusted based on the amine selected, design experience and economy. An essentially sulfur free hydrocarbon vapor (e.g. containing 10 to 1000 ppm by weight hydrogen sulfide) is withdrawn via line 77.

The material which does not vaporize and remain in the vessel is a thermal tar. As the coking reaction progresses, the coke drum fills with thermal tar which is converted at these coking reaction conditions to coke. At the end of the coking cycle, the coke is removed from the drum by cutting with a high impact water jet. The cut coke is washed to the coke pit and coke dewatering pad. The coke is broken into lumps and may be calcined at a temperature of 2000° F. (1649° C.) prior to sampling and analysis for grading.

Premium grade coke, referred to in the art as needle grade coke, is used to make steel and for specialty alloy applications. This product has a coefficient of thermal expansion of 0.5 to $5\times10^{-7}$ cm/cm/°C., an ash content of 0.001 to 0.02 wt %, volatiles of about 3 to 6 wt % and sulfur of about 0.1 to 1 wt %.

Aluminum grade coke, referred to in the art as anode grade coke, is used in the manufacturing of aluminum. This product has a density of about 0.75 to 0.90 gm/cc, an ash content of about 0.05 to 0.3 wt %, volatiles of about 7 to 11 wt % and sulfur of about 0.5 to 2.5 wt %.

Fuel grade coke typically has an ash content of about 0.1 to 2 wt %.

The invention was discovered by experimentation. Although the mechanism is not known with certainty, the experimental results are reproducible as demonstrated in the Example and support the following hypothesis. Asphaltenes in petroleum or coal derived hydrocarbon stocks are present in the form of colloid particles termed micelles having a size of one millimicron or greater. Micelles comprise an aggregation of asphaltene macro molecules and carry a valence charge. These micelles are thermodynamically unstable at a steam or hot water and oil interface. Forming the interface causes the micelle to dissociate into the constituent asphaltene macro molecules which carry the valence charge from the micelle of origin.

Asphaltene macro molecules comprising both a valence charge and a covalent moiety are thermodynamically more stable at an oil-water interface than entirely in either the oil phase or the water phase. At the interface the covalent moiety resides in the oil phase while the valence charged moiety resides in the water or steam phase. The macro molecule is thereby suspended at the oil-water interface. Oil-water emulsions and oil-steam foams have a large interphase surface area providing a stabilizing suspending medium for asphaltene macro molecules.

In the delayed coking process the asphaltene molecules are dissociated from their micelles with water and subjected to thermal cracking temperatures in the furnace tube. The cracked asphaltene molecules are separated by a greater distance than they would be if cracked as micelles. Cracked asphaltene free radicals contact much shorter cracked oil free radicals to yield condensable liquid hydrocarbons. Hydrogen and hydroxide radicals are also available at thermocracking reaction conditions. These radicals also combine with cracked asphaltene radicals to yield condensable liquid.

Hydrogen production from the process has also been discovered. Consistent with this is the enhanced disulfurization which has been discovered.

According to the invention, the thermal cracking atmosphere is modified to yield hydrocarbon liquids and to prevent polymerization to yield coke. This invention is shown by way of Example.

EXAMPLE

Run numbers are reported directly from Inventors' laboratory notebooks. This accounts for any apparent redundancies, or omission in sequence.

EXAMPLE 1

Coker charge was the 1000° F.+ vacuum residuum from an Arabian medium/heavy crude. Asphaltene content was 25 wt %. Asphaltene content is the amount of precipitate formed by mixing 1 part of oil with 50 parts heptane and standing for 12 hours at room temperature. Carbon residue was 20.9 wt % according to ASTM D-4530.

In Run 2 the coker charge was admixed with an equal weight of water and heated in a pilot unit at a furnace temperature of 930° F. The heated charge was then passed to the coke drum at 800° F. The volatile hydrocarbons were withdrawn and passed to a separator/condenser at 15 psig and room temperature. After 2 hours of coking, feed to the furnace was discontinued. The accumulated coke was steamed for 1 hour then cooled to room temperature. The coke yield was measured as 18 wt % and the liquid yield as 63 wt % based on the weight of the vacuum residuum.

The theoretical minimum amount of coke derivable from a feedstock is the amount of asphaltene. The theoretical minimum coke derivable from this 1000° F.+ vacuum residuum coker charge is 25 wt % based on asphaltene content. The expected amount of coke is 33 wt % based on carbon residue (ASTM D-4530).

In Comparative Run 34 the vacuum residuum was mixed with helium instead of water. The volume of helium was the same as the volume of steam formed in Run 2. The vacuum residuum was again coked for 2 hours as in Run 2 and the coke steamed for 1 hour. Comparative Run 34 furnace and coke drum temperatures were 900° F. The coke yield was 31 wt %, as predicted by carbon residue and by commercial experience. The hydrocarbon liquid yield was 51 wt %.

Comparative Run 34 demonstrates that water or steam in the identified amounts is not inert in the delayed coking reaction as disclosed in the prior art.

In Run 35 the vacuum residuum was mixed with twice as much water on a weight basis and coked for 2 hours as in Run 34. The coke yield was 15 wt % and the liquid yield was 80 wt %. Run 35 demonstrates that liquid yield is increased and both coke and gas yield is reduced.

EXAMPLE 2

The coker charge was a 1000° F.+ vacuum residuum from Kern River crude oil. The coker charge had a hydrogen/carbon (H/C) atomic ratio of 1.41, contained 1.71 wt % sulfur and 11 wt % heptane insoluble asphaltenes. The carbon residue was 16.5 wt % (ASTM D-4530). The expected coke yield from this coker charge was 6.4 wt %.

Hydrocarbon and water when used were mixed at the furnace inlet. The charge mixture was heated to 900°–950° F., and passed to the coke drum. The temperature in the coke drum was approximately 800° F. The gas was withdrawn and passed to a condenser/separator cooled with process water. Liquids accumulated in the condenser/separator, and gases withdrawn overhead. The separator was relatively inefficient, the gases containing butanes and lighter.

In Comparative Runs 205 and 186, no water was added to the coker charge. Comparative Run 205 furnace temperature was 900° F., and coke drum pressure was 45 psig. Comparative Run 186 furnace temperature was 950° F. and coke drum pressure was atmospheric.

| | | | | Yield, wt % | | |
|---|---|---|---|---|---|---|
| Run | $H_2O$ Wt % | T, °F. | P, atm | Coke | Liquid | Gas |
| 205 | 0 | 900 | 3 | 26 | 67 | 7 |
| 186 | 0 | 950 | 1 | 19 | 56 | 25 |

In Runs 186–193 water was added to the coker charge. These Runs demonstrate that liquid yields can be improved with water in the feed.

| | | | | Yield, wt % | | |
|---|---|---|---|---|---|---|
| Run | $H_2O$, Wt % | T, °F. | P, atm | Coke | Liquid | Gas |
| 189 | 3.8 | 900 | 1 | 19 | 59 | 22 |
| 190 | 10.7 | 900 | 1 | 18 | 67 | 13 |
| 191 | 16.7 | 900 | 1 | 19 | 69 | 13 |
| 192 | 21.9 | 900 | 1 | 18 | 64 | 18 |
| 193 | 26 | 900 | 1 | 18 | 69 | 12 |

In Runs 194–197, furnace temperature was increased to 950° F. Runs 194–197 demonstrate 1–17 wt % water.

| | | | | Yield, wt % | | |
|---|---|---|---|---|---|---|
| Run | $H_2O$, Wt % | T, °F. | P, atm | Coke | Liquid | Gas |
| 194 | 1. | 950 | 1 | 15 | 65 | 20 |
| 196 | 10.7 | 950 | 1 | 13 | 67 | 20 |
| 197 | 16.7 | 950 | 1 | 17 | 73 | 10 |

In Runs 174–184 the feedstock water mixture was passed through a 60 micron metal frit to make a high interfacial area feedstock emulsion.

In Runs 179–184 furnace temperature was 900° F.

| | | | | Yield, wt % | | |
|---|---|---|---|---|---|---|
| Run | $H_2O$, Wt % | T, °F. | P, atm | Coke | Liquid | Gas |
| 179 | 3.8 | 900 | 1 | 19 | 54 | 27 |
| 180 | 10.7 | 900 | 1 | 19 | 61 | 20 |
| 181 | 16.7 | 900 | 1 | 17 | 63 | 21 |
| 182 | 21.8 | 900 | 1 | 17 | 68 | 15 |
| 183 | 26.5 | 900 | 1 | 18 | 74 | 7 |
| 184 | 30.6 | 900 | 1 | 16 | 76 | 7 |

In Runs 171–177 furnace temperature was 925° F.

| | | | | Yield, wt % | | |
|---|---|---|---|---|---|---|
| Run | $H_2O$, Wt % | T, °F. | P, atm | Coke | Liquid | Gas |
| 171 | 1.9 | 925 | 1 | 17 | 63 | 20 |
| 172 | 3.8 | 925 | 1 | 18 | 59 | 23 |
| 174 | 16.7 | 925 | 1 | 16 | 64 | 20 |
| 175 | 21.8 | 925 | 1 | 14 | 72 | 14 |
| 176 | 26.4 | 925 | 1 | 14 | 77 | 8 |
| 177 | 30.6 | 925 | 1 | 18 | 70 | 13 |

In Runs 161–168 furnace temperature was 950° F.

| | | | | Yield, wt % | | |
|---|---|---|---|---|---|---|
| Run | $H_2O$, Wt % | T, °F. | P, atm | Coke | Liquid | Gas |
| 161 | 1.3 | 950 | 1 | 11 | 69 | 20 |
| 162 | 3.8 | 950 | 1 | 13 | 84 | 20 |
| 163 | 10.7 | 950 | 1 | 13 | 82 | 5 |
| 165 | 16.7 | 950 | 1 | 16 | 88 | — |
| 166 | 21.8 | 950 | 1 | 11 | 85 | 4 |
| 167 | 26.5 | 950 | 1 | 12 | 69 | 19 |
| 168 | 29.7 | 950 | 1 | 12 | 70 | 18 |

Runs 161–184 demonstrate that water in amounts of 10–30 wt % reduced gas yields and as a result increased the liquid/coke yield ratio.

In Runs 206–209 coke drum pressure was 3 atm. S is sulfur in product liquid.

| | | | | Yield, wt % | | |
|---|---|---|---|---|---|---|
| Run | $H_2O$, Wt % | T, °F. | Wt % S | Coke | Liquid | Gas |
| 206 | 0.5 | 950 | 1.3 | 25 | 69 | 6 |
| 208 | 3.8 | 950 | 1.4 | 22 | 76 | 2 |
| 209 | 10.7 | 950 | 0.7 | 14 | 73 | 13 |

Runs 206–209 demonstrated that a higher drum pressure in combination with approximately 10% water caused more liquid product desulfurization and higher hydrogen/carbon (H/C) atomic ratio. Run 33 demonstrated 57% desulfurization of the liquid hydrocarbon feedstock and increased hydrocarbon liquid H/C ratio.

Run 209 and Runs 161–305 demonstrated that significantly higher liquid/coke yields were obtained with water in amounts greater than 10 wt %.

In Runs 44(2)–47(2), steam was injected directly into the furnace tube.

| Run | $H_2O$, wt % | T, °F. | P, atm | Yield, wt % Coke | Liquid | Gas |
|---|---|---|---|---|---|---|
| 46(2) | 20.6 | 925 | 1 | 18 | 82 | — |
| 45(2) | 26.5 | 925 | 1 | 16 | 80 | 4 |
| 44(2) | 30.6 | 925 | 1 | 16 | 82 | 2 |
| 47(2) | 30.6 | 950 | 1 | 15 | 80 | 5 |

Runs 44 (2)–47 (2) demonstrated that high liquid/coke yields are obtained by injecting steam into the furnace tube.

EXAMPLE 3

Feedstock was the vacuum residuum of Example 1. Both furnace and coke drum temperature were 800° F.

The heated vacuum residuum was passed through the furnace to the coke drum. Volatile hydrocarbons were withdrawn overhead and passed to a separator/condenser at 15 psig and room temperature. After 2 hours of coking, the feed was discontinued. Accumulated coke was steamed for 1 hour then cooled to room temperature.

Runs 34 and 30 demonstrated the effect of a water-oil feed to the coker furnace. Run 34 without water, produced a liquid/coke yield of 1.64. Run 30 was with 67 wt % water, producing a liquid/coke yield of 1.92.

| Run | $H_2O$, Wt % | Yield, Wt % Liquid | Coke | Gas |
|---|---|---|---|---|
| 34 | 0 | 51 | 31 | 18 |
| 30 | 67 | 65 | 28 | 7 |

In Runs 80, 86 and 90 the influence of the hydrogen donors tetralin, alkylate, and coker gas oil on the liquid/coke yield was demonstrated. Feedstock was the same as Example 1.

| Run | $H_2$ Donor, wt % | Water wt % | Yield. Wt % Liquid | Coke | Gas |
|---|---|---|---|---|---|
| 30 | None | 67 | 65 | 28 | 7 |
| 80 | tetralin 20% | 67 | 74 | 18 | 8 |
| 86 | alkylate 10% | 67 | 78 | 21 | 1 |
| 90 | Coker Gas Oil 10% | 67 | 79 | 21 | 0 |

Less water was used in Runs 46, 54, 79 and 87.

| Run | $H_2$ Donor, wt % | Water wt % | Yield, wt % Liquid | Coke | Gas |
|---|---|---|---|---|---|
| 46 | None | 28.6 | 59 | 39 | 2 |
| 54 | tetralene 10% | 28.6 | 60 | 26 | 14 |
| 79 | tetralene 20% | 28.6 | 67 | 21 | 12 |
| 87 | alkylate 10% | 28.6 | 62 | 24 | 14 |

The feedstock of Example 1 was used for runs 40, 39 and 61. Coke drum pressure was 30–40 psig.

| Run | $H_2$ Donor, wt % | Water, Wt % | Yield, Wt % Liquid | Coke | Gas |
|---|---|---|---|---|---|
| 40 | 0 | 0 | 58 | 24 | 18 |
| 39 | 0 | 67 | 67 | 25 | 8 |
| 61 | Coker Gas Oil 7.5% | 67 | 73 | 15 | 12 |

Runs 40, 39 and 61 demonstrate that coker gas oil in addition to water increased the liquid/coke yield from 2.65/1 to 4.95/1 from a commercial heavy residuum feedstock.

EXAMPLE 4

Feedstock was the vacuum residuum of Example 1. The delayed coking pilot unit furnace temperature was 900° F.

The heated charge was fed to the coke drum maintained at 800° F. The volatile hydrocarbons were withdrawn and passed to a separator/condenser operating at 15 psig and room temperature. Coking continued for 2 hours.

Runs 34 and 30 demonstrate the effect of a water-oil feed to the coker furnace. Comparative Run 34 with no water, produced a liquid/coke yield of 1.64. Run 30 with 67 wt % water, produced a liquid/coke yield of 1.92.

| Run | $H_2$ Donor Wt % | Water wt % | Yield, Wt % Liquid | Coke | Gas |
|---|---|---|---|---|---|
| 34 | 0 | 0 | 51 | 31 | 18 |
| 30 | 0 | 67 | 65 | 28 | 7 |

Runs 74 and 76 demonstrate the influence of hydrogen donor gases, methane and carbon monoxide, on the liquid/coke yield. The amount Ha Donor gas is reported as weight of gas/weight water.

| Run | $H_2$ Donor Wt % | Water wt % | Yield, Wt % Liquid | Coke | Gas |
|---|---|---|---|---|---|
| 30 | — | 67 | 65 | 28 | 7 |
| 74 | CO 0.75 | 67 | 60 | 16 | 24 |
| 76 | Methane 0.39 | 67 | 60 | 25 | 15 |
| 30 | — | 67 | 65 | 28 | 7 |
| 78 | tetralin 20% | 67 | 62 | 16 | 22 |
| 82 | tetralin 20% $H_2$ 0.02 | 67 | 75 | 19 | 6 |

The hydrogen donors, methane, hydrogen, syngas and coker gas oil were demonstrated in Runs 90 to 93. Syngas was a 1/1 molar $CO/H_2$ mixture. The amount of hydrogen donor gas is reported as weight of gas/weight water.

| Run | $H_2$ Donor, Wt % | Gas | Water, wt % | Yield, wt % Liquid | Coke | Gas |
|---|---|---|---|---|---|---|
| 90 | Coker Gas Oil 10% | — | 67 | 79 | 23 | — |
| 91 | Coker Gas Oil 10% | $H_2$ 0.01 | 67 | 77 | 20 | 3 |
| 92 | Coker Gas Oil 10% | $CH_4$ 0.08 | 67 | 67 | 18 | 15 |

-continued

| Run | $H_2$ Donor, Wt % | Gas | Water, wt % | Yield, wt % Liquid | Coke | Gas |
|---|---|---|---|---|---|---|
| 93 | Coker Gas Oil 10% | Syngas 0.07 | 67 | 70 | 22 | 8 |

EXAMPLE 5

The furnace had two temperature zones. The first zone was operated at a temperature between 670° F. and 750° F. The second zone was operated at a temperature between 800° F. and 900° F. Gas was withdrawn from the coke drum and passed to a separator/condenser operating at 15 psig and room temperature. Liquid hydrocarbons accumulated in the separator while gas was withdrawn overhead. Samples of the gas were analyzed by gas chromatography for hydrogen, carbon monoxide, carbon dioxide, hydrogen sulfide, oxygen, nitrogen, and hydrocarbon. Coking conditions for the feedstock of Example 1 and the feedstock of Example 2 are reported. The Runs demonstrate hydrogen production

FEEDSTOCK OF EXAMPLE 1

| FEEDSTOCK OF EXAMPLE 1 | Run 73 | 34 | 46 | 16 |
|---|---|---|---|---|
| Residuum/Water (wt/wt) | 112/0 | 48/0 | 110/40 | 23/121 |
| Zone I Temp, °F. | 750 | 750 | 700 | 670 |
| Zone II Temp, °F. | 900 | 900 | 900 | 930 |
| Drum Temp, °F. | 825 | 900 | 800 | 900 |
| $CO_x$ vol % | 0.06 | 0.06 | 3.7 | 1.76 |
| $H_2$ vol % | 0.15 | 0 | 33.5 | 9.08 |

FEEDSTOCK OF EXAMPLE 2

| FEEDSTOCK OF EXAMPLE 2 | Run 40 | 39 |
|---|---|---|
| Residuum/Water wt/wt | 50/0 | 50/100 |
| Zone I Temp °F. | 750 | 750 |
| Zone II Temp °F. | 900 | 900 |
| Drum Temp °F. | 900 | 900 |
| $CO_x$ vol % | 0.04 | 2.13 |
| $H_2$ vol % | 0.04 | 4.8 |

EXAMPLE 6

Feedstock was the residuum of Example 2. Furnace temperature was 950° F. Coke drum temperature was 950° F. and pressure was 15 psig.

Comparative Run 154 without water produced a liquid/coke yield of 2.38. The sulfur content of the liquid product was 1.5 wt %.

Next, water in the feedstock was varied between 3.9 wt % and 30.6 wt %. The liquid to coke yield increased to 6.71/1, and the sulfur content of the liquid products was reduced.

| Run | Water, wt % | Yield wt % Liquid | % S in Liq | Coke |
|---|---|---|---|---|
| 154 | 0 | 28 | 1.50 | 12 |
| 155 | 3.9 | 38 | 1.51 | 12 |
| 156 | 10.7 | 55 | 1.38 | 13 |
| 157 | 16.7 | 67 | 1.25 | 10 |
| 158 | 21.9 | 79 | 1.23 | 12 |
| 159 | 26.5 | 79 | 1.17 | 17 |
| 160 | 30.6 | 83 | 1.38 | 13 |

EXAMPLE 7

A Kern River crude oil having 13° API gravity, 1.1 wt % sulfur content and 119 ppm metals was fractionated to remove the 450° F. and lighter fraction. The residuum had an 12.40° API gravity and 1.09% sulfur. The residuum was mixed with water and fed to the furnace of a delayed coking pilot unit. The furnace temperature was 950° F. and a pressure was 150–300 psig. The heated charge was passed to the coke drum at 800° F. Volatile hydrocarbons were withdrawn and passed to a separator/condenser at 15 psig and room temperature. After 2 hours, coking was discontinued. The accumulated coke was steamed for 1 hour and then cooled to room temperature. Coke yields, liquid yields, API gravity, sulfur content of the liquid hydrocarbon product are recorded.

TABLE I

| Run | Water, wt % | °API | % S | Yield, wt % Liquid | Coke | Gas |
|---|---|---|---|---|---|---|
| 151 | 6.4 | 19.6 | 0.57 | 89 | 6.9 | 4.1 |
| 150 | 14.7 | 17.4 | 0.95 | 84 | 5.1 | 10.9 |
| 149 | 28.5 | 15.4 | 0.98 | 93 | 5.4 | 1.6 |
| 57 | 28.5 | 21.9 | 0.81 | 61 | 12.4 | 26.6 |

In Run 57 the un-fractionated Kern River crude oil was coked. Runs 149, 150, and 151 show that the same amount of upgrading can be achieved after the gas oil fraction has been removed from the crude oil.

EXAMPLE 8

Kern River crude oil having 13° API and a H/C ratio of 1.43 was fractionated to remove 450° F. and lighter. The residuum had 12.4° API and a 1.35 H/C ratio. The residuum was mixed with water and a hydrogen donor, passed through to the furnace at 950° F. and 150–300 psig and then to the coke drum at 800° F. The volatile hydrocarbons were withdrawn to a separator/condenser operating at 15 psig and room temperature. After 2 hours, coking was discontinued. The results of these runs are shown below. The amount of $H_2$ Donor is reported as weight of gas to weight of water. The syngas was 1/1 molar $CO/H_2$.

| Run | $H_2$ Donor | $H_2O$, wt % | API | H/C | Yield, wt % Liquid | Coke | Gas |
|---|---|---|---|---|---|---|---|
| 149 | — | 28.5 | 15.4° | 1.63 | 93 | 5.4 | 1.6 |
| 152 | 2.0 $CH_4$ | 14.7 | 16.7 | 1.59 | 88 | 5.8 | 6.2 |
| 153 | 2.0 Syngas | 14.7 | 15.5 | 1.67 | 78 | 4.7 | 17.3 |

API gravity and H/C ratio of the residual oil is increased with water and a hydrogen donor gas.

While particular embodiments of the invention have been described, it will be understood, of course, that the invention is not limited thereto since many modifications may be made, and it is, therefore, contemplated to cover by the appended claims any such modification as fall within the true spirit and scope of the invention.

What is claimed is:

1. A delayed coking process for the conversion of a residual oil feedstock comprising carbon residue to produce coke, hydrocarbon liquid and gas, the process comprising the steps of:

a. measuring an amount of carbon residue in the residual oil feedstock according to ASTM D-4530 to produce a measurement, b. admixing with the residual oil feedstock, water in an amount of 3 wt % to 70 wt % to produce an admixture, c. subjecting the admixture to delayed coking reaction conditions; thereby yielding coke in an amount less than 1.6 times the measurement of carbon residue.

2. The process of claim 1 wherein the admixture comprises 10 wt % to 30 wt % water.

3. The process of claim 1 wherein the water is in the form of liquid water or steam.

4. The process of claim 1 wherein the admixture is a residual oil feedstock—liquid water emulsion.

5. The process of claim 1 wherein the admixture is a residual oil feedstock—steam foam.

6. A delayed coking process for the conversion of a residual oil feedstock comprising carbon residue to produce coke, hydrocarbon liquid and gas; the process comprising the steps of:

a. measuring an amount of carbon residue in the residual oil feedstock according to ASTM D-4530 to produce a measurement, b. admixing with the residual oil feedstock: water in an amount of 3 wt % to 30 wt % and a hydrogen donor liquid in an amount of 0.01 wt % to 33 wt % to produce an admixture, c. subjecting the admixture to delayed coking reaction conditions;

thereby yielding coke in an amount of less than 1.6 times the measurement of carbon residue.

7. The process of claim 6 wherein the admixture comprises 10 wt % to 30 wt % water.

8. The process of claim 6 wherein the admixture comprises 10 wt % to 30 wt % water and 0.1 wt % to 15 wt % hydrogen donor liquid.

9. The process of claim 6 wherein the hydrogen donor liquid is in an amount of 0.1 to 0.5 of the amount of water.

10. The process of claim 6 wherein the water is in the steam state and the hydrogen donor liquid is in an amount of 0.1 to 0.5 by weight of the amount of steam.

11. The process of claim 6 wherein the hydrogen donor liquid is gas oil.

12. A delayed coking process for the conversion of a residual oil feedstock comprising carbon residue to produce coke, hydrocarbon liquid and gas; the process comprising the steps of:

a. measuring an amount of carbon residue in the residual oil feedstock according to ASTM D-4530 and measuring an amount of residual oil feedstock, b. admixing with the residual oil feedstock, water in the amount of 10 wt % to 30 wt % to produce an admixture, c. subjecting the admixture to delayed coking reaction conditions;

thereby yielding coke in an amount less than 1.6 times the amount of carbon residue in the residual oil feedstock and gas in an amount less than 10 wt % of the amount of residual oil feedstock.

13. The process of claim 12 wherein the water is in the form of liquid water or steam.

14. The process of claim 12 wherein the admixture is a residual oil feedstock—liquid water emulsion.

15. The process of claim 12 wherein the admixture is a residual oil feedstock—steam foam.

16. A delayed coking process for the conversion of a residual oil feedstock comprising carbon residue to produce coke, hydrocarbon liquid and gas, the process comprising the steps of:

a. measuring an amount of carbon residue in the residual oil feedstock according to ASTM D-4530 and measuring an amount of residual oil feedstock, b. admixing with the residual oil feedstock: water in an amount of 10 wt % to 70 wt % and a hydrogen donor gas selected from the group consisting of hydrogen, methane, carbon monoxide, synthesis gas and mixtures thereof in an amount of 0.01 wt % to 1 wt % to produce an admixture, subjecting the admixture to delayed coking reaction conditions;

thereby yielding coke in an amount of less than 1.6 times the amount of carbon residue in the residual oil feedstock and gas in an amount less than 10 wt % of the amount of residual oil feedstock.

17. The process of claim 16 wherein the water is in the form of liquid water or steam.

18. The process of claim 16 wherein the admixture is a residual oil feedstock—steam foam.

19. The process of claim 16 wherein the admixture is a residual oil feedstock—liquid water emulsion.

20. The process of claim 16 wherein the hydrogen donor gas is methane.

21. The process of claim 16 wherein the hydrogen donor gas is hydrogen.

22. The process of claim 16 wherein the hydrogen donor gas is synthesis gas.

* * * * *